United States Patent [19]

Auclair et al.

[11] Patent Number: 4,834,682

[45] Date of Patent: May 30, 1989

[54] ELECTRICAL CONNECTOR FOR BRAIDED CONDUCTORS

[76] Inventors: William T. Auclair, Pinney St., Winsted, Conn. 06098; Randolph L. Auclair, Old Kinsey Rd., New Hartford, Conn. 06057

[21] Appl. No.: 145,058

[22] Filed: Jan. 19, 1988

[51] Int. Cl.[4] ..... H01R 43/00

[52] U.S. Cl. ..... 439/883; 439/885

[58] Field of Search ..... 439/92, 883, 885; 29/863, 864, 869

[56] References Cited

U.S. PATENT DOCUMENTS

| | | | |
|---|---|---|---|
| 1,702,756 | 2/1929 | Woodbridge | 439/883 |
| 1,890,368 | 12/1932 | Chesler . | |
| 2,462,993 | 3/1949 | Peters . | |
| 2,553,051 | 5/1951 | Kingman . | |
| 3,038,245 | 6/1962 | Dexter | 29/864 |
| 3,301,940 | 1/1967 | Rischard . | |
| 3,587,030 | 6/1971 | Ohnsorg et al. . | |
| 4,428,317 | 10/1984 | Oliver et al. . | |
| 4,664,158 | 5/1987 | Sands . | |
| 4,741,704 | 5/1988 | DeLuca | 439/92 |

*Primary Examiner*—Eugene R. LaRoche
*Assistant Examiner*—Robert J. Pascal
*Attorney, Agent, or Firm*—Chilton, Alix & Van Kirk

[57] ABSTRACT

A braided wire electrical connector employs eyelets of one-piece integral form for providing electrical connections with a termination point. Integral arms extend from an eyelet head and are crimped to the braided wire to fasten the eyelet to the braided wire.

4 Claims, 2 Drawing Sheets

ELECTRICAL CONNECTOR FOR BRAIDED CONDUCTORS

BACKGROUND OF THE INVENTION

This invention relates generally to braided conductors which are employed as mechanical and electrical connectors for bonding and grounding connections. More specifically, this invention relates to braided wires which employ conductive eyelets for providing electrically-conductive connections with a terminal.

Flexible braided wires of conductive material employed for providing electrical connections for grounding and similar applications are well known. It is also well known to provide openings in the braided wires for receiving a threaded fastener for connecting and securing the braids to a termination point. Electrically-conductive eyelets or grommets have been mounted at the braid openings for enhancing the electrical and mechanical connection between the braid and the termination point.

It is a principal aim of the present invention to provide a new and improved connector for continuous length braid wherein electrically conductive eyelets may be affixed to the braid in a highly efficient manner to provide enhanced electrical connection between the braid and a termination point.

BRIEF SUMMARY OF THE INVENTION

Briefly stated, the invention in a preferred form is an electrical connector which comprises a braided wire formed from a multiplicity of electrically conductive strands. The braid has spaced first and second surfaces and a plurality of openings which extend through the surfaces. Eyelets of electrically conductive material and one-piece integral form are received in the openings and crimped to the braided wire. Each eyelet comprises a tubular shank which extends through a braid opening. The tubular shank has an axially spaced first end and a second end. A flanged head extends from the first end of the shank and engages portions of the first surface adjacent the opening. A pair of arms integrally extend from the head at generally diametral positions therefrom. The arms extend a sufficient distance and are crimped so as to engage both the first and the second surfaces of the braid to securely fasten the eyelet to the braid. A second set of radially projecting arms integrally project from the second end of the tubular shank and crimpingly engage the second surface. The two sets of arms cooperate to form a crimp having a B-shaped configuration. The eyelets function to gather the wires of the braid and the B-shaped crimp provides a gas-tight, compact, proper electrical termination. The one-piece integral form effectively reduces manufacturing costs.

An object of the invention is to provide a new and improved braided wire with eyelet terminal connectors which may be manufactured and assembled in an efficient and relatively low cost manner.

An object of the invention is to provide a new and improved eyelet for a braided conductive wire which may be efficiently inserted into a braid opening and crimped into position.

A further object of the invention is to provide a new and improved electrically conductive braided wire having a terminal eyelet which provides vibration and corrosion resistant electrical connection of high integrity.

Other objects and advantages of the invention will become apparent from the drawings and the specification.

DETAILED DESCRIPTION OF THE INVENTION

Figure 1:
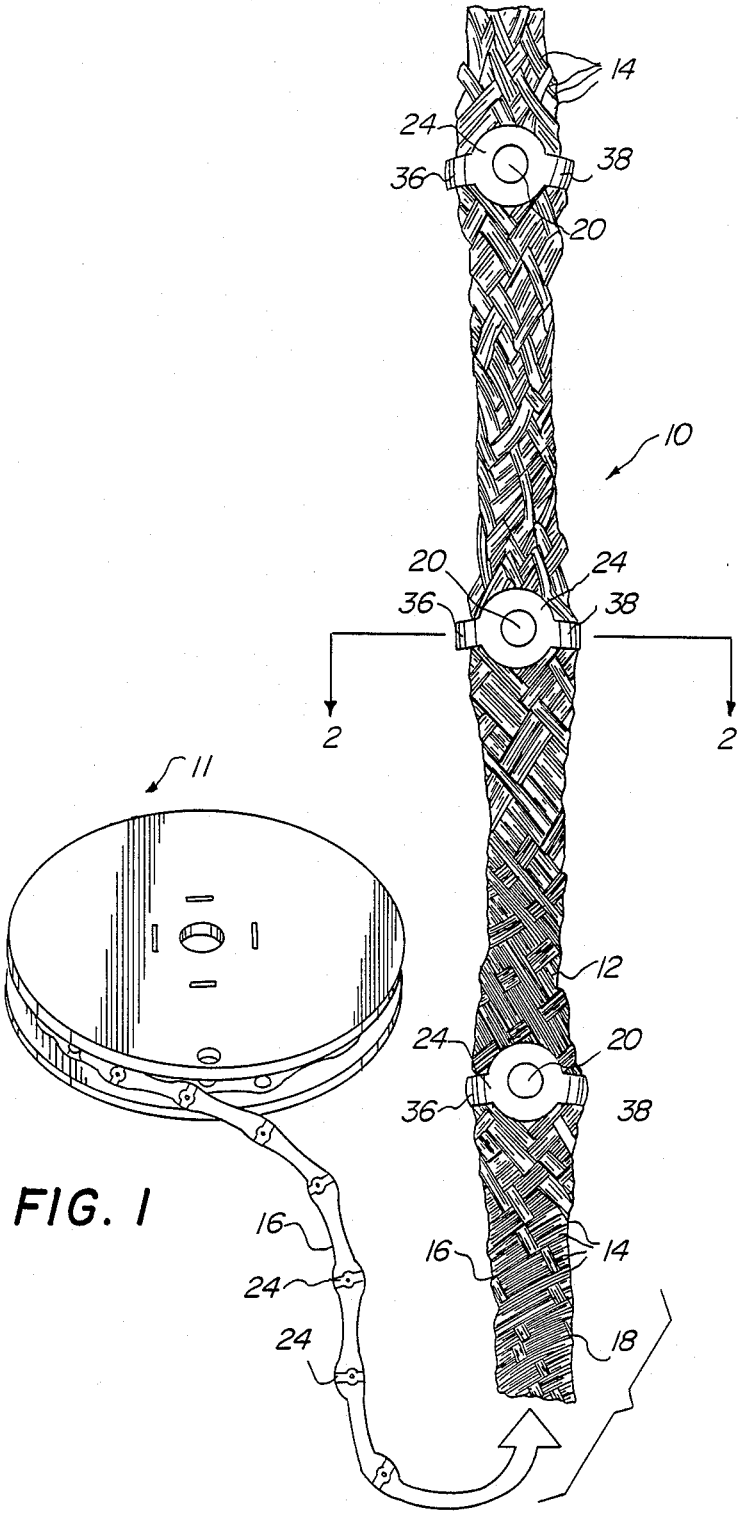
FIG. 1 is a top plan view of a portion of a braided wire electrical connector in accordance with the present invention together with a perspective view, partly in schematic, of a continuous ground connector coil.

With reference to the drawings wherein like numerals represent like parts throughout the figures, a braided wire electrical connector in accordance with the present invention is generally designated by the numeral 10. The connector 10, as illustrated in FIG. 1, is a portion of continuous coil 11 which may typically be 25 or 50 feet in length. Sections of the coil are typically cut to a given length with splice snips (not illustrated) in accordance with the requirements of a given application.

The electrical connector 10 preferably comprises a flexible braided wire 12 of interwoven groups of electrically conductive wires or strands 14. The wire 12 initially has a generally uniform width and thickness and defines a top surface 16 and an opposing bottom surface 18. Substantially, identical apertures 20 are formed at generally equidistantly spaced positions along the length of the wire. The apertures 20 are equidistantly spaced from the side edges of the wire and open through the wire surfaces 16 and 18. The formation of the apertures may result in the transverse enlargement of the width of the wire in the vicinity of the apertures. In one embodiment, the centers of the apertures are 3 inches apart, and the width of the wire ranges from approximately $\frac{1}{2}$ inch to approximately $\frac{3}{4}$ inch in the vicinity of the apertures.

An eyelet 24 in accordance with the invention is received in each aperture 20 and secured to the braided wire 12 to facilitate an electrical connection between a threaded terminal (not illustrated) and the wire.

Figure 2:
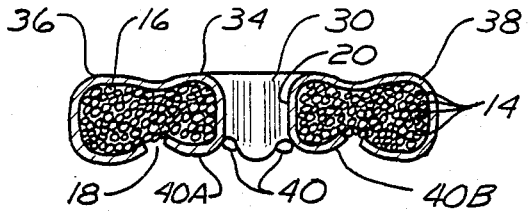
FIG. 2 is a sectional view of the electrical connector taken along the line 2—2 of FIG. 1.
Figure 3:
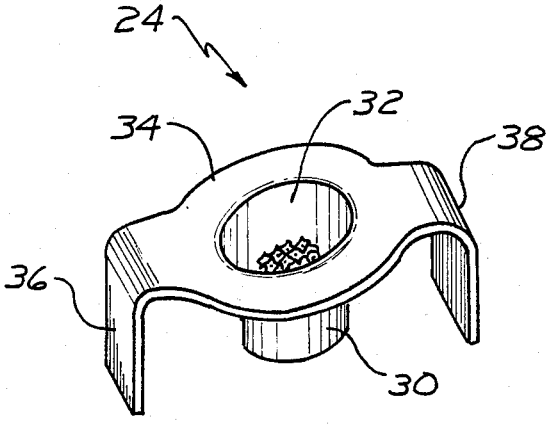
FIG. 3 is a perspective view of an eyelet for the electrical connector of FIG. 1.

The eyelet 24 is an integral one-piece structure as best illustrated in FIGS. 2 and 3. Each eyelet 24 is a grommet-like member which is clamped in position at a corresponding aperture in a rivet-type fashion (as illustrated in FIG. 3) as will be more fully described below.

Prior to assembly with the braided wire, the eyelet has a generally tubular shank 30 of generally uniform cylindrical shape defining a central interior eyelet recess 32. Typically, recess 32 has a diameter on the order of $\frac{1}{4}$ inch. An annular flanged head 34 integrally extends from one end of the tubular shank and generally encircles the recess opening through the tubular shank. A pair of substantially identical arms 36 and 38 of uniform width integrally extend from diametral locations at the periphery of the flanged head 34. Prior to assembly, the arms 36 and 38 partially extend radially from head 34 in generally coplanar orientation and at the terminal portions extend obliquely in generally parallel relationship as best illustrated in FIG. 3.

The eyelets 24 are inserted into the apertures 20 so that the arms 36 and 38 and the flanged head 34 engage surface 16. The arms 36 and 38 are generally transversely oriented relative to the longitudinal extent of the braided wire. The arms 36 and 38 are then bent at the braid edges and crimped so as to clampingly engage both the top surface 16 and the opposing portions of the bottom surface 18 while gathering the strands from the sides of the braided wire to form a proper, compact gas-tight connection.

The tubular end portion of the shank 30 opposite the flanged head 34 substantially simultaneously with the crimping of the head and arms is segmented and crimped against the underside surface 18 of the wire to form a multiplicity of generally radially projecting, serrated or segmented arms 40. Two opposing serrated arms 40*a* and 42*b*, cooperate with respective integral arms, 36 and 38, to form a B-shaped crimp against the conductive strands as best illustrated in FIG. 2. It will be appreciated that the foregoing crimp connection can be accomplished in an efficient manner wherein the cross-sectional area of the braided wire stands is greatly reduced with the voids being nearly eliminated through the resulting metal flow of the conductive wires and the eyelet connector. The crimping action causes the wire conductors 14 and eyelet 24 to essentially cold flow into a solid mass creating a connection of high electrical conductivity and high mechanical pull-out strength. The resulting electrical connection is highly resistant to mechanical vibration and corrosion. The resulting electrical connector or braided wire is ordinarily transversely enlarged to form a quasi-bulbous-shape in the vicinity of the mounted eyelet upon crimping the eyelet 24 to the braided wire 12.

It will be appreciated that eyelets 24 are inserted in each of the apertures and crimped into a secure fastening engagement with the braided wire in continuous fashion in the same manner as previously described.

While a preferred embodiment of the foregoing invention has been set forth for purposes of illustration, the foregoing description should not be deemed a limitation of the invention herein. Accordingly, various modifications, adaptations, and alternatives may occur to one skilled in the art without departing from the spirit and the scope of the present invention.

What is claimed is:

1. An electrical connector comprising:

an elongated braided wire comprising a multiplicity of electrically conductive strands and having spaced first and second surfaces extending between opposing edges and means defining an aperture opening through said surfaces; and an eyelet of electrically conductive material and one-piece integral form received in said aperture and fastened to said braided wire, said eyelet comprising:

a tubular shank extending through said aperture and having an axially spaced first and second portion;

a flanged head extending from said first portion and engaging portions of said first surface adjacent said aperture; and first and second arms integrally extending from said head at generally diametral positions therefrom, each said arm being dimensioned to extend a distance substantially greater than the distance between the aperture and an opposing edge and being bent so as to crimpingly engage said first and second surfaces and gather portions of braided wire to securely fasten said eyelet to said wire.

2. The electrical connector of claim 1 further comprising a set of segmented arms which integrally extend from said shank at said second portion and crimpingly engage said second surface.

3. The electrical connector of claim 2 wherein one of said segmented arms and one said integral arm cooperate to form a crimp having a B-shaped section.

4. The electrical connector of claim 1 wherein said wire comprises means defining plurality of longitudinally spaced apertures, each aperture receiving a corresponding substantially identical eyelet of electrically conductive material and one-piece integral form fastened to said braided wire.

* * * * *